US011654072B2

(12) United States Patent
Fei

(10) Patent No.: US 11,654,072 B2
(45) Date of Patent: May 23, 2023

(54) KNEE REHABILITATION MACHINE WITH MULTI-POSITION SYNCHRONOUS FORCE APPLICATION

(71) Applicant: Jinghao Fei, Beijing (CN)

(72) Inventor: Jinghao Fei, Beijing (CN)

( * ) Notice: Subject to any disclaimer, the term of this patent is extended or adjusted under 35 U.S.C. 154(b) by 0 days.

(21) Appl. No.: 17/837,168

(22) Filed: Jun. 10, 2022

(65) Prior Publication Data

US 2022/0296452 A1 Sep. 22, 2022

Related U.S. Application Data

(63) Continuation of application No. PCT/CN2020/087098, filed on Apr. 27, 2020.

(30) Foreign Application Priority Data

Dec. 16, 2019 (CN) ..... 201911289938.9

(51) Int. Cl.
*A61H 1/02* (2006.01)
*A61H 23/02* (2006.01)

(52) U.S. Cl.
CPC ..... *A61H 1/024* (2013.01); *A61H 1/0229* (2013.01); *A61H 23/0254* (2013.01); *A61H 2201/1481* (2013.01); *A61H 2201/1642* (2013.01); *A61H 2201/1676* (2013.01)

(58) Field of Classification Search
CPC .. A61H 1/024; A61H 1/0229; A61H 23/0254; A61H 2201/1481; A61H 2201/1642; A61H 2201/1676; A61H 1/00; A61H 1/0218; A61H 23/02; A61H 2201/1207; A61H 2205/102; A61H 1/0237; A61H 2201/14; A61H 2201/1418; A61H 2201/1436; A61H 2201/1454; A61H 2201/149; A61F 5/042; A61F 5/0104
See application file for complete search history.

(56) References Cited

U.S. PATENT DOCUMENTS

| | | | | |
|---|---|---|---|---|
| 3,661,149 A * | 5/1972 | Ferries | ..... | A61H 1/0237 601/35 |
| 4,111,195 A | 9/1978 | Neufeld | | |
| 2014/0088466 A1* | 3/2014 | Hansen | ..... | A61G 13/009 482/129 |

(Continued)

FOREIGN PATENT DOCUMENTS

| | | |
|---|---|---|
| CN | 2671527 Y | 1/2005 |
| CN | 108186182 A | 6/2018 |
| CN | 207693852 U | 8/2018 |

(Continued)

OTHER PUBLICATIONS

Internation Search Report of PCT/CN2020/087098, dated Sep. 21, 2020.

*Primary Examiner* — Quang D Thanh

(57) ABSTRACT

A knee rehabilitation machine with multi-position synchronous force application includes a bottom box, a vertical box, and a suspension box. The vertical box is vertically arranged at an end of the bottom box, and an upper end of the vertical box is horizontally fixed with the suspension box. A pressing unit swing lever mechanism is arranged in the bottom box, and a vibration unit, a pulling unit, and a transmission mechanism of a pressing unit are arranged in the vertical box.

7 Claims, 6 Drawing Sheets

(56) References Cited

U.S. PATENT DOCUMENTS

| | | | | |
|---|---|---|---|---|
| 2016/0271443 | A1* | 9/2016 | Malizia | A61H 1/024 |
| 2017/0239119 | A1* | 8/2017 | Stewart | A61G 13/1245 |

FOREIGN PATENT DOCUMENTS

| | | | |
|---|---|---|---|
| CN | 208372101 | U | 1/2019 |
| CN | 109875840 | A | 6/2019 |
| CN | 110494111 | A | 11/2019 |
| CN | 110840643 | A | 2/2020 |
| JP | 1080440 | A | 3/1998 |
| JP | 2008062003 | A | 3/2008 |
| JP | 2018075063 | A | 5/2018 |
| KR | 20150075338 | A | 7/2015 |

* cited by examiner

KNEE REHABILITATION MACHINE WITH MULTI-POSITION SYNCHRONOUS FORCE APPLICATION

CROSS REFERENCE

This application is a continuation of International Patent Application No. PCT/CN2020/087098 with a filing date of Apr. 27, 2020, designating the United States, and further claims priority to Chinese Patent Application No. 201911289938.9 with a filing date of Dec. 16, 2019. The content of the aforementioned applications, including any intervening amendments thereto, are incorporated herein by reference.

TECHNICAL FIELD

The present disclosure belongs to the field of medical equipment, in particular to a knee rehabilitation machine with multi-position synchronous force application.

BACKGROUND knee arthrosis is one of the diseases with a high incidence in China, especially in the northern regions with cold climate. The percentage of middle-aged and elderly people who are completely healthy in both knees due to degenerative bone changes is quite low; the number of young people who suffer from knee arthrosis due to sports injuries or inappropriate sports and excessive exercise is also unignorable. The main symptoms of knee arthrosis are pain, fluid accumulation, joint entrapment, bone spur proliferation, and activity restriction, etc. In serious cases, the symptoms include bone deformation, difficulty in walking, difficulty in squatting on their own, and inability to go up and down stairs normally, so that the quality of life decreases and even life cannot be taken care of.

Drug and minimally invasive surgical treatments focus on eliminating inflammation, removing bone spurs, effusion, trauma and other lesions in order to alleviate the disease, reduce pain and restore function to a certain extent, but there is no correction for knee instability. Only knee replacement surgery can be performed, by osteotomy of the femur and tibia followed by implantation of a prosthesis, to correct the instability and relieve the pain. However, knee arthrosis is a recurring and persistent disease that strikes every time the weather turns cold or there are certain triggers, and each time the patient is treated, he or she suffers great pain and has to pay thousands or tens of thousands of CNY in medical bills, with little hope of a cure.

For the persistent disease of the knee joint, repeated and prolonged medication is required, and damage to the body organs is inevitable. The physical injuries of surgical treatment such as bone amputation, destruction of fascia muscles, and the sequelae of surgery such as infection, deep vein thrombosis, and joint loosening instability can seriously affect the quality of life. The life span of a joint prosthesis is 15 years, and even if the patient has the possibility of replacing it again, the cost of the surgery of 100,000-300,000 and the sequelae of the surgery are a great financial and mental stress for the patient. Therefore, technological innovation for the health care rehabilitation of the knee joint is very necessary and in great demand by society.

A search of the public patent literature reveals the following five patents related to the present disclosure.

1. Knee rehabilitation instrument (CN 110494111A), including: a thigh fixation unit, inserted into a thigh portion of a leg to be rehabilitated for fixation; a calf fixation unit, configured adjacent to the thigh fixation unit, inserted into a calf portion of the leg to be rehabilitated for fixation; and a knee position guiding member, configured between the thigh fixation unit and the calf fixation unit, and configured to guide a position of a knee when the leg to be rehabilitated being inserted into the thigh fixation unit and the calf fixation unit.

2. Knee rehabilitation device (CN 105853147B), relating to the field of physiotherapy apparatus, and especially to the improvement for knee rehabilitation device. A knee rehabilitation device with a compact structure, easy to use and good stability, which can be properly adjusted for people with different leg lengths when used, and supplemented with calf muscle massage, is proposed. A foot plate brace is arranged vertically and slidingly connected to a top surface of a base, and a heel of the foot plate is hinged to a top of a foot plate brace; a main driving device includes interconnected driving rod and power source, the power source is fixedly connected in the base, the driving rod is arranged vertically and its top extends above the base, the knee joint brace is fixedly connected to a top of the driving rod and can be driven by the power source to make a linear reciprocating movement in the vertical direction. The knee rehabilitation device can provide a good and effective massage to the calf muscles during the knee rehabilitation, which has the characteristics of compact structure, easy to use and good stability.

3. Knee rehabilitation device (CN 208372101U), including: a mounting frame; a swing arm, rotatably connected to the mounting frame, an end of the swing arm being connected to a first telescopic rod, the other end of the swing arm being connected to a second telescopic rod, and an end of the second telescopic rod being connected to at least one foot retainer; a locking and positioning structure, including a positioning disk and a locking mechanism; wherein in a state where the locking mechanism is locked to the positioning disk, the swing arm can be locked and fixed relative to the mounting frame. The knee rehabilitation device can perform knee flexion exercises and knee compression straightening exercises for patients, and its structure is simple and easy to operate and use.

4. Knee rehabilitation instrument (CN 104771304B), including a knee massage bracket, a knee wheel bracket, a knee wheel drive motor, a drive gear, a driven gear, a drive shaft, a knee drive wheel, a knee swing wheel, and a gripper; the knee massage bracket is plugged and set on a front bracket, the knee wheel drive motor is set in the middle of the knee massage bracket to drive the drive gears on both sides, a pair of the knee swing wheels are set symmetrically on both sides of the knee wheel drive motor, and the gripper is set below the knee swing wheel. The knee rehabilitation instrument can promote blood circulation and relax the muscles by massaging the knee joint with the gripper; the knee rehabilitation instrument is practical and can be widely promoted; the core components of the knee rehabilitation instrument are mechanical components with good reliability and long life.

5. Knee rehabilitation apparatus (CN 208388944U), relating to the technical field of knee rehabilitation, including a pulling device, an angle measuring device, a traction fixing device, and a suspension device; wherein the pulling device is configured to be mounted on an affected limb, the angle measuring device is configured to measure the patient's bending angle; the suspension device is configured to suspend the affected limb; the traction fixing device is fixed on the human body, the pulling device is arranged with a pulling rope connected to the pulling fixing device. The pulling device of the knee rehabilitation apparatus is connected with the traction fixing device, and the patient suspends the affected limb on the suspension device, and the pulling device changes the length of the release of the pulling rope to realize the pulling of the patient's knee joint, while the angle measuring device can measure the angle of flexion of the patient's knee joint and precisely control the angle of flexion of the knee joint, which is helpful to recover and exercise the flexibility of the knee joint.

SUMMARY OF THE DISCLOSURE

The purpose of the present disclosure is to overcome the shortcomings of the related art and to provide a knee rehabilitation machine with multi-position synchronous force application, which simulates the traditional Chinese medicine corrective techniques to correct the instability of the knee joint, realizes the adjustment of the relationship between the femur and tibia through suspension, pulling, twisting and vibration with controlled force, angle and distance, and uses the body's own memory to return it to the normal natural state, thereby correcting the instability of the knee joint, eliminating the caused discomfort, and preventing the occurrence of knee arthrosis.

The present disclosure is implemented by follows.

A knee rehabilitation machine with multi-position synchronous force application, comprising a bottom box, a vertical box, and a suspension box; wherein the vertical box is vertically arranged at an end of the bottom box, and an upper end of the vertical box is horizontally fixed with the suspension box; a pressing unit swing lever mechanism is arranged in the bottom box, and a vibration unit, a pulling unit, and a transmission mechanism of a pressing unit are arranged in the vertical box; a movable strap is arranged on the suspension box, which is configured to bind a calf of a patient; a fixed shaft roller is coaxially arranged at an outer end of the suspension box, and the fixed shaft roller is arranged with a fixing strap configured to fix and bind a thigh of the patient; the vibration unit in the vertical box drives a fork to swing through a reduction motor; a roller coaxially arranged in the suspension box is fixed on an upper end of the fork; the roller is capable of swinging synchronously with a swing of the fork; the movable strap is fixed on the roller and is capable of swinging with the roller; the transmission structure of the pressing unit in the vertical box is a swing lever mechanism that uses a swing of the roller to drive the pressing unit in the bottom box; two pressing vertical rods symmetrically arranged on both sides of the calf of the patient are capable of swinging, and the two pressing vertical rods snap together to connect to a magic buckle with a shape similar to a knee joint, thereby clasping the knee joint of the patient; the pulling unit in the vertical box is driven by another reduction motor to pull two traction belt rods at the same time to pull the calf of the patient axially, while two horizontal tightening buckles on both sides of the thigh of the patient are connected with an axial positioning strap to bind and axially position the thigh of the patient.

In some embodiments, the reduction motor is arranged on a bracket fixed in the vertical box; a drive shaft of the reduction motor is coaxially fixed with a turntable; a pin shaft is fixedly arranged parallel to an outer side of a disk of the turntable, and a runner is coaxially arranged on an outer end of the pin shaft; a shaft roller is horizontally arranged in the suspension box, and an inner end of the shaft roller is arranged by means of a bearing through a bearing seat fixed in a suspension beam; an outer end of the shaft roller is arranged on the suspension box; the fork is fixed on the inner end of the shaft roller, and a lower part of the fork defines a long through hole for guiding the runner running the pin shaft in the long through hole; when the turntable rotates, the fork swings to both sides with a circular movement of the pin shaft, thereby driving a swinging movement of the shaft roller.

In some embodiments, a cam disc is fixed coaxially on the shaft roller outside the fork of the vibration unit; the cam disc is in an inverted center structure; a vertical moving rod is arranged at a lower end of the cam disc, and a lower end of the vertical moving rod is hinged on a hinge beam; each side of the hinge beam is hinged with a lower swing lever, an inner end of each lower swing lever is hinged with a hinge frame through a hinge shaft, and an outer end of each lower swing lever is hinged with a corresponding pressing vertical rod through another hinge shaft.

In some embodiments, the another reduction motor is fixed in the vertical box, an output shaft of the another reduction motor is coaxially arranged with a drive gear, and the drive gear meshes with a driven gear in a structure same as the drive gear; an outer disk surface of each of the drive gear and the driven gear is fixed with a sheave wheel, and a pulling belt is wound around the sheave wheel; a cross beam is cantilevered and fixed to an end of a horizontal bracket below the sheave wheels, and a guide wheel is fixed on an end of the cross beam; the pulling belt of each sheave wheel is snap connected with a corresponding traction belt rod on a side of the calf of the patient through a corresponding guide wheel.

In some embodiments, a swinging angle of the fork is in a range of 0° to ±60°.

In some embodiments, a vertical guide sleeve is arranged on the vertical moving rod, and a recovery spring is arranged on the vertical moving rod at an upper end of the vertical guide sleeve.

In some embodiments, a vertical guiding sleeve is arranged between each guide wheel and a corresponding sheave wheel, and a horizontal guiding sleeve is arranged between each guide wheel and a corresponding traction belt rod.

The advantages and positive effects of the present disclosure are as followed.

The present disclosure simulates the traditional Chinese medicine for the correction of the knee joint instability state, realizes the synchronous scientific force adjustment of the relationship between the femur and tibia through suspension, pulling, twisting, pressing, and vibration with controlled force, angle and distance, and use the body's own memory to return to its normal natural state, thereby correcting the instability of the knee joint, eliminating the caused discomfort, and preventing the occurrence of knee arthrosis.

DETAILED DESCRIPTION

The following further describes the present disclosure with reference to the following examples: the following examples are illustrative and not restrictive, and the following examples cannot be used to limit the scope of the present disclosure.

Figure 1:
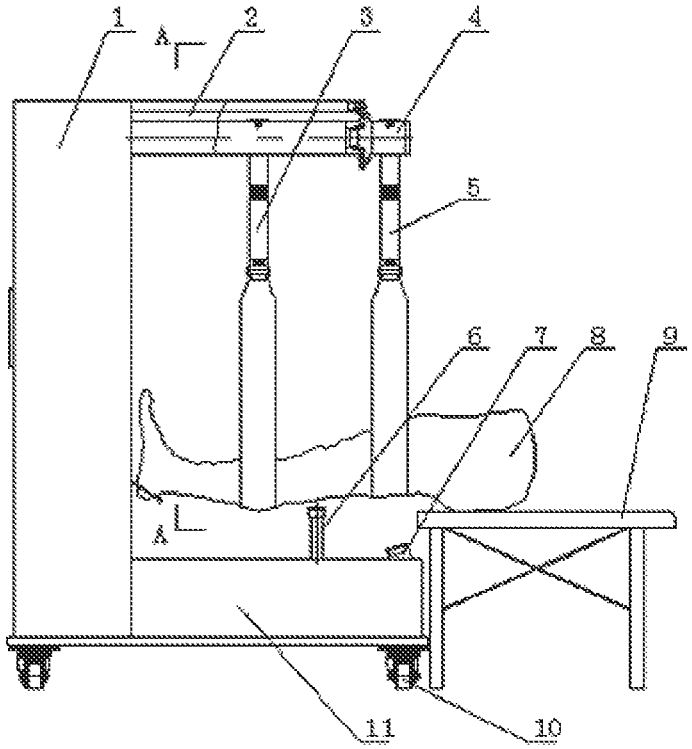
FIG. 1 is a structural front view of a knee rehabilitation machine with multi-position synchronous force application of the present disclosure.
Figure 2:
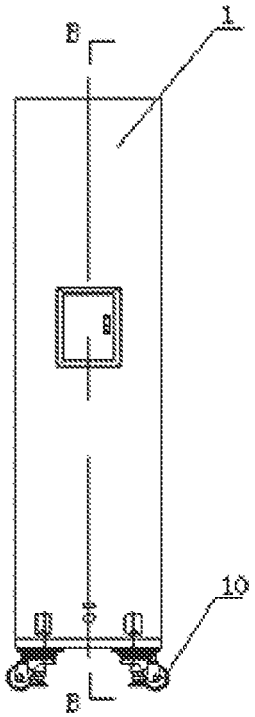
FIG. 2 is a structural left view of the knee rehabilitation machine with multi-position synchronous force application shown in FIG. 1.
Figure 3:
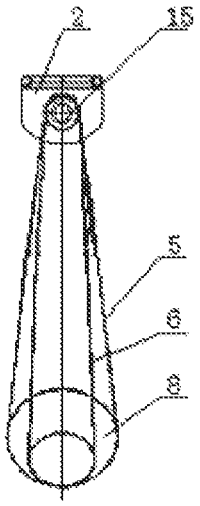
FIG. 3 is a cross-sectional section in the A-A direction of FIG. 1.
Figure 4:
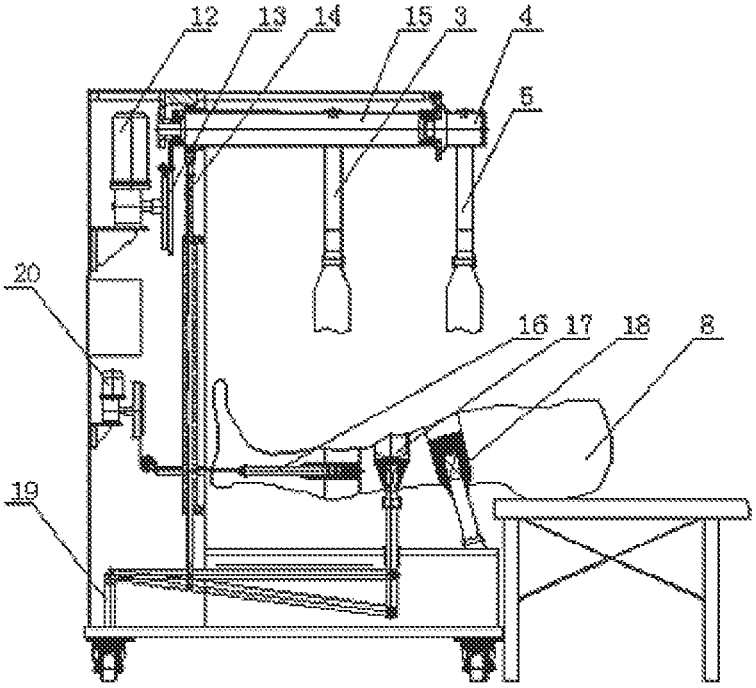
FIG. 4 is a cross-sectional section in the B-B direction of FIG. 2.

A knee rehabilitation machine with multi-position synchronous force application includes a bottom box 11, a vertical box 1 and a suspension box 2; the vertical box 1 is vertically arranged at an end of the bottom box 11, and an upper end of the vertical box 1 is horizontally fixed with the suspension box 2. Lower bottom corners of the bottom box 11 are arranged with Vientiane rollers 10 to realize the movement of the whole mechanism; a connecting table 9 is arranged on an outside of the bottom box 11 for a patient 8 to lie down; a pressing unit swing lever mechanism is arranged in the bottom box 11, and a vibration unit, a pulling unit, and a transmission mechanism of a pressing unit are arranged in the vertical box 1; a movable strap 3 is arranged on the suspension box 2, which is configured to bind a calf of the patient; a fixed shaft roller 4 is coaxially arranged at an outer end of the suspension box 2, and the fixed shaft roller 4 is arranged with a fixing strap 5 for fixing and binding a thigh of the patient, as shown in FIG. 4. In addition, the bottom box 11 is further arranged with two pressing vertical rods 6 symmetrically disposed on both sides of a knee of the patient and two horizontal tightening buckles 7 disposed on both sides of the thigh.

The overall internal structure of the present disclosure is shown in FIG. 4. The vibration unit in the vertical box 1 drives a fork 13 to swing through a reduction motor 12. A roller 15 coaxially arranged in the suspension box 2 is fixed on an upper end of the fork 13. The roller 15 swings synchronously with the swing of the fork 13. The movable strap 3 is fixed on the roller 15 and swings with the roller 15. The swinging angle is in a range of 0° to ±60°, and the optimal swinging angle is in a range of ±25° to ±40°. Since the fixing strap 5 fixes the patient's thigh, and the movable strap 3 produces a swing with a certain angle, this arrangement may realize the suspension of the patient's thigh, promote blood circulation, and allows the patient's knee to be regularly twisted and shaken, which promotes the patient's knee joint exercise and restore. In addition, the pulling unit in the vertical box 1 is driven by another reduction motor 20 to pull two traction belt rods 16 at the same time to pull the patient's calf axially, while the two horizontal tightening buckles 7 on both sides of the patient's thigh are connected with an axial positioning strap 18, which bind the patient's thigh and position it axially, so as to realize the straightening recovery of the knee joint. The transmission structure of the pressing unit in the vertical box 1 is a swing lever mechanism that uses swing of the roller 15 to drive the pressing unit in the bottom box 11. By swinging the two pressing vertical rods 6 symmetrically arranged on both sides of the patient's calf, the two pressing vertical rods 6 snap together to connect to a magic buckle 17 with a shape similar to the knee joint, thereby clasping the patient's knee joint, which realizes the compression of the patient's knee joint, corrects the instability of the knee joint, eliminates various discomfort caused by it, and prevents the occurrence of the knee arthrosis. Therefore, in the present disclosure, suspension, vibration, pulling and pressing are applied to the patient's knee joint simultaneously, overcoming the possible damage to the patient's knee joint caused by the single application of force to the knee joint in the related art, and realizing effective rehabilitation training of the knee joint with perfect comprehensive rehabilitation effect.

The specific structures of the above units are described in detail below.

Figure 5:
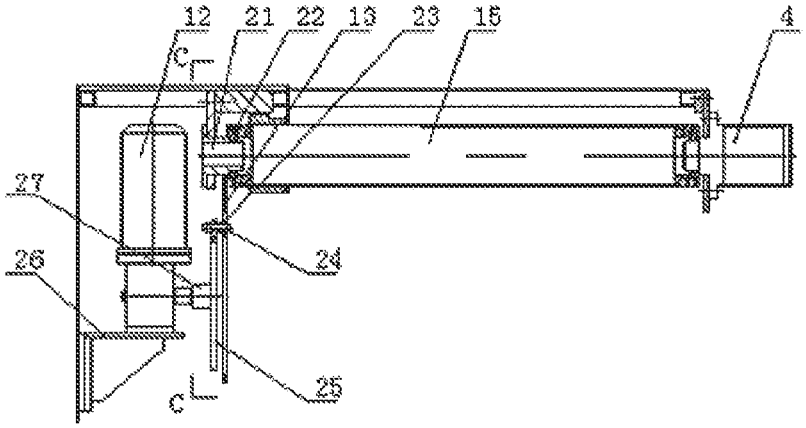
FIG. 5 is an enlarged structural schematic view of a vibration unit of the present disclosure.
Figure 6:
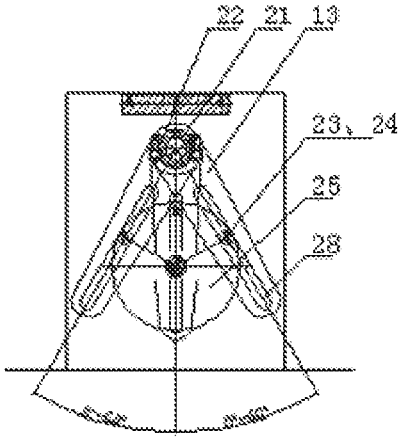
FIG. 6 is a cross-sectional section in the C-C direction of FIG. 5.

1. The structure of the vibration unit will be described in conjunction with FIGS. 5 and 6. The reduction motor 12 is arranged on a bracket 26 fixed in the vertical box 1. A drive shaft 27 of the reduction motor 12 is coaxially fixed with a turntable 25. A pin shaft 24 is fixedly arranged parallel to an outer side of a disk of the turntable 25, and a runner 23 is coaxially arranged on an outer end of the pin shaft 24; a shaft roller is horizontally arranged in the suspension box 2, and an inner end of the shaft roller is arranged by means of a bearing 22 through a bearing seat 21 fixed in a suspension beam. An outer end of the shaft roller is arranged on a position of the suspension box 2, and the position of the suspension box 2 is fixed to the fixed shaft roller 4 arranged coaxially with the shaft roller; the fork 13 is fixed on the inner end of the shaft roller, and a lower part of the fork 13 defines a long through hole 28, which can guide the runner 23 running the pin shaft 24 in the long through hole 28. The runner 23 may be made of bearings or similar products, so that when the turntable 25 rotates, the fork 13 swings to both sides with a circular movement of the pin shaft 24, thereby driving the swinging movement of the shaft roller.

Figure 7:
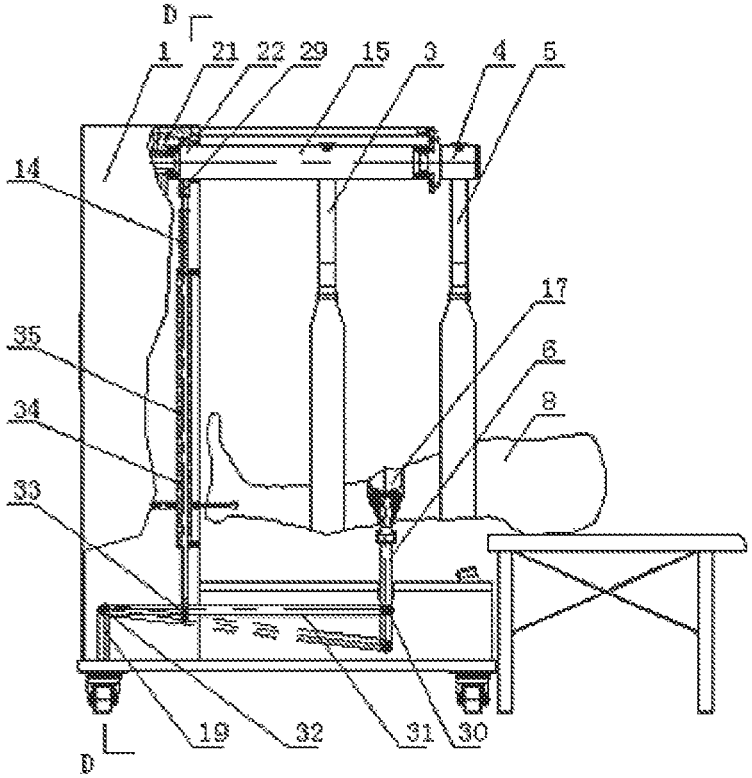
FIG. 7 is a partial sectional schematic view of FIG. 1.
Figure 8:
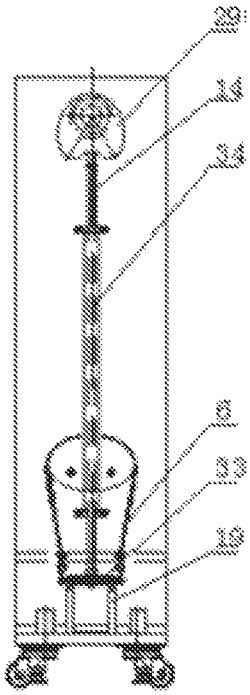
FIG. 8 is a cross-sectional section in the D-D direction of FIG. 7.

2. The structure of the pressing unit will be described in conjunction with FIGS. 7 and 8. On the shaft roller outside the fork 13 of the vibration unit, a cam disc 29 is fixed coaxially. The cam disc 29 is in an inverted center structure; a vertical moving rod 35 is arranged at the lower end of the cam disc 29, and a lower end of the vertical moving rod 35 is hinged on a hinge beam 33; each side of the hinge beam 33 is hinged with a lower swing lever 31, an inner end of each lower swing lever 31 is hinged with a hinge frame 19 through a hinge shaft 32, and an outer end of each lower swing lever 31 is hinged with a corresponding pressing vertical rod 6 through a hinge shaft 30. In order to ensure the vertical displacement of the vertical moving rod 35, a vertical guide sleeve 34 is added to the vertical moving rod 35. In order to ensure that the vertical moving rod 35 maintains a flexible fitting displacement with the cam disc 29, a recovery spring 14 is arranged on the vertical moving rod 35 at an upper end of the vertical guide sleeve 34.

When the roller 15 swings, the cam disc 29 swings at the same time, a raised part of the cam disc 29 presses the vertical moving rod 35 and makes the vertical moving rod 35 fit a cam surface by the action of the recovery spring 14. The vertical moving rod 35 moves up and down to drive the lower swing lever 31 to swing up and down with the hinge frame 19 as a shaft. The two pressing vertical rods 6 hinged at the outer end of the lower swing lever 31 are also vertically displaced up and down to achieve compression training and recovery of the patient's knee joint.

Figure 9:
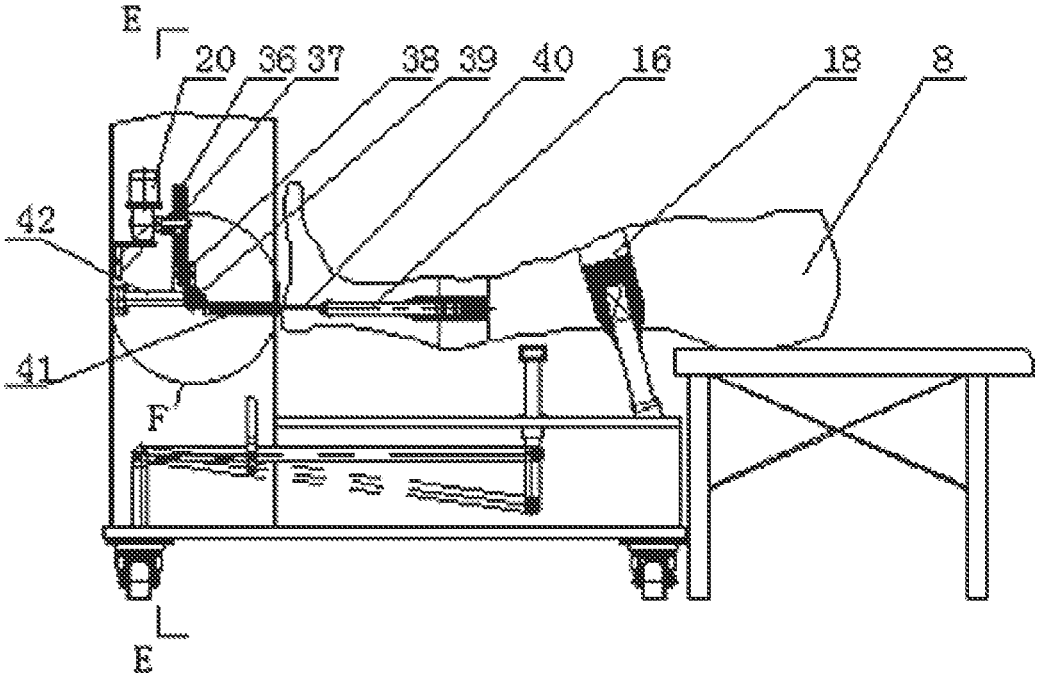
FIG. 9 is an enlarged structural schematic view of a pulling unit of the present disclosure.
Figure 10:
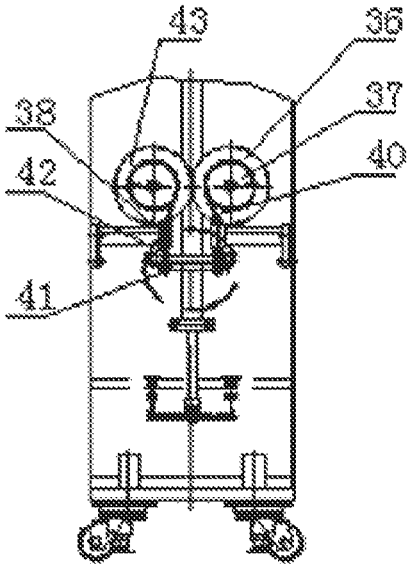
FIG. 10 is a cross-sectional section in the E-E direction of FIG. 9.
Figure 11:
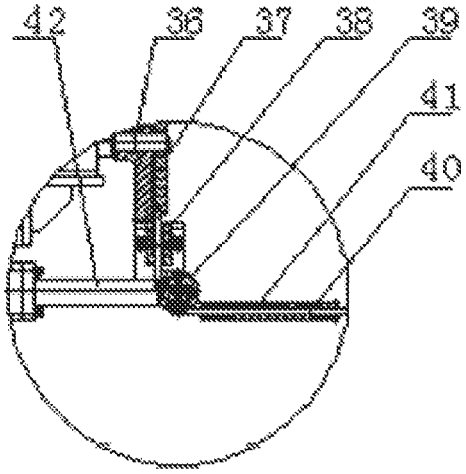
FIG. 11 is an enlarged structural schematic view of a part F in FIG. 9.

3. The structure of the pulling unit will be described in conjunction with FIGS. 9, 10, and 11 The reduction motor 20 is fixed in the vertical box 1, an output shaft of the reduction motor 20 is coaxially arranged with a drive gear 36, and the drive gear 36 meshes with a driven gear 43 in a structure same as the drive gear 36. An outer disk surface of each of the drive gear 36 and the driven gear 43 is fixed with a sheave wheel 37. A pulling belt 40 is wound around each of the two sheave wheels 37. A cross beam is cantilevered and fixed to an end of a horizontal bracket 42 below the sheave wheels 37, and a guide wheel 39 is fixed on an end of the cross beam. The pulling belt 40 of the sheave wheel 37 is snap connected with a corresponding traction belt rod 16 on a side of the calf through a corresponding guide wheel 39. In order to ensure smooth guiding of the running of the pulling belt 40, a vertical guiding sleeve 38 is further arranged between each guide wheel 39 and the corresponding sheave wheel 37, and a horizontal guiding sleeve 41 is further arranged between each guide wheel 37 and the corresponding traction belt rod 16.

The above structure may realize that, when the reduction motor 20 rotates, the two gears 36 and 43 that mesh with each other are driven to rotate, and the sheave wheels 37 arranged on the gears 36 and 43 rotate. At this time, the pulling belts 40 arranged on the sheave wheels 37 are pulled upwards. Due to the action of the guide wheels 39, the pulling belts 40 stretch the patient's knee to condition and train the instability of the knee joint.

What is claimed is:

1. A knee rehabilitation machine with multi-position synchronous force application, comprising a bottom box, a vertical box, and a suspension box; wherein the vertical box is vertically arranged at an end of the bottom box, and an upper end of the vertical box is horizontally fixed with the suspension box; a swing lever mechanism of a pressing unit is arranged in the bottom box, and a vibration unit, a pulling unit, and a transmission mechanism of the pressing unit are arranged in the vertical box;

a movable strap is arranged on the suspension box; a first shaft roller is firmly and coaxially arranged at an outer end of the suspension box, and the first shaft roller is arranged with a fixing strap configured to fix and bind a thigh of the patient;

the vibration unit in the vertical box drives a fork to swing through a reduction motor; a roller coaxially arranged in the suspension box is fixed on an upper end of the fork; the roller is capable of swinging synchronously with a swing of the fork; the movable strap is fixed on the roller and is capable of swinging with the roller;

the transmission mechanism of the pressing unit in the vertical box drives the swing lever mechanism of the pressing unit in the bottom box by a swing of the roller; two pressing vertical rods adapted to be symmetrically arranged on both sides of the calf of the patient are capable of swinging, and the two pressing vertical rods snap together to connect to a knee-joint-shaped buckle with a shape similar to a knee joint, thereby clasping the knee joint of the patient;

the pulling unit in the vertical box is driven by another reduction motor to pull two traction belt rods, while two horizontal tightening buckles adapted to be on both sides of the thigh of the patient are connected with an axial positioning strap adapted to bind and axially position the thigh of the patient.

2. The knee rehabilitation machine according to claim 1, wherein the reduction motor is arranged on a bracket fixed in the vertical box; a drive shaft of the reduction motor is coaxially fixed with a turntable; a pin shaft is fixedly arranged parallel to an outer side of a disk of the turntable, and a runner is coaxially arranged on an outer end of the pin shaft; a second shaft roller is horizontally arranged in the suspension box, and an inner end of the second shaft roller is arranged by means of a bearing through a bearing seat fixed in a suspension beam; an outer end of the second shaft roller is arranged on the suspension box; the fork is fixed on the inner end of the second shaft roller, and a lower part of the fork defines a long through hole for guiding the runner running the pin shaft in the long through hole; when the turntable rotates, the fork swings to both sides with a circular movement of the pin shaft, thereby driving a swinging movement of the second shaft roller.

3. The knee rehabilitation machine according to claim 2, wherein a cam disc is fixed coaxially on the second shaft roller outside the fork of the vibration unit; the cam disc is in an inverted center structure; a vertical moving rod is arranged at a lower end of the cam disc, and a lower end of the vertical moving rod is hinged on a hinge beam; each side of the hinge beam is hinged with a lower swing lever, an inner end of each lower swing lever is hinged with a hinge frame through a hinge shaft, and an outer end of each lower swing lever is hinged with a corresponding pressing vertical rod through another hinge shaft.

4. The knee rehabilitation machine according to claim 1, wherein the another reduction motor is fixed in the vertical box, an output shaft of the another reduction motor is coaxially arranged with a drive gear, and the drive gear meshes with a driven gear; an outer disk surface of each of the drive gear and the driven gear is fixed with a sheave wheel, and a pulling belt is wound around the sheave wheel; a cross beam is cantilevered and fixed to an end of a horizontal bracket below the sheave wheels, and each of two ends of the cross beam is provided with a guide wheel; the pulling belt of each sheave wheel is snap connected with a traction belt rod through the corresponding guide wheel.

5. The knee rehabilitation machine according to claim 1, wherein a swinging angle of the fork is in a range of 0° to ±60°.

6. The knee rehabilitation machine according to claim 3, wherein a vertical guide sleeve is arranged on the vertical moving rod, and a recovery spring is arranged on the vertical moving rod at an upper end of the vertical guide sleeve.

7. The knee rehabilitation machine according to claim 4, wherein a vertical guiding sleeve is arranged between each guide wheel and a corresponding sheave wheel, and a horizontal guiding sleeve is arranged between each guide wheel and a corresponding traction belt rod.

* * * * *